US005141216A

United States Patent [19]

Ballestrazzi et al.

[11] Patent Number: 5,141,216

[45] Date of Patent: Aug. 25, 1992

[54] APPARATUS FOR THE CONTROLLED FEED OF PRODUCTS IN SHEET FORM IN A COLLATING OR PACKAGING MACHINE

[75] Inventors: Aris Ballestrazzi; Lamberto Tassi, both of Savignano Sul Panaro, Italy

[73] Assignee: Sitma S.p.A., Spilamberto, Italy

[21] Appl. No.: 605,343

[22] Filed: Oct. 30, 1990

[30] Foreign Application Priority Data

Nov. 2, 1989 [IT] Italy ..... 22032/89[U]

[51] Int. Cl.[5] ..... B65H 5/00; B65H 5/16

[52] U.S. Cl. ..... 271/10; 271/9; 271/271; 198/457; 198/468.8; 270/58

[58] Field of Search ..... 271/6, 9, 10, 12, 269; 53/154, 447; 198/457, 968.8; 270/58

[56] References Cited

U.S. PATENT DOCUMENTS

| | | | |
|---|---|---|---|
| 3,054,612 | 9/1962 | Godlewski | 270/58 |
| 3,158,366 | 11/1964 | Godlewski | 271/119 |
| 3,260,517 | 7/1966 | Sather | 270/58 |
| 3,404,880 | 10/1968 | Porter, Jr. et al. | 270/58 |
| 3,965,644 | 6/1976 | Stocker | 270/58 |
| 4,494,742 | 1/1985 | Guenther et al. | 270/58 |
| 4,511,132 | 4/1985 | Müller | 270/58 |
| 4,577,848 | 3/1986 | Hams | 270/58 |
| 4,720,960 | 1/1988 | Green | 271/9 |
| 4,865,304 | 9/1989 | Vander Syde et al. | 270/58 |
| 4,991,831 | 2/1991 | Green | 271/121 |

FOREIGN PATENT DOCUMENTS 2533874 2/1976 Fed. Rep. of Germany .

*Primary Examiner*—H. Grant Skaggs
*Assistant Examiner*—Steven M. Reiss
*Attorney, Agent, or Firm*—Hedman, Gibson, Costigan

[57] ABSTRACT

Apparatus for the controlled feeding of products in sheet form in a collating or packaging machine comprising a framework on which there is installed a magazine portion containing the products in sheet form to be fed, a drawing/advancement unit for drawing one of the products in sheet form from the magazine portion and for advancing it towards a push-bar conveyor on top of which one of the products in sheet form, drawn in that way, has to be placed. This apparatus comprises at least one accompanying element which performs the task of accompanying the so-drawn product in sheet form to the top of the push-bar conveyor, with at least one accompanying element being interposed between the drawing/advancement unit and the push-bar conveyor, with actuation elements being furthermore provided. The actuation elements perform the task of actuating accompanying element, and intervene whenever the drawn product in sheet form has left the drawing/advancement unit and is placed in the nearby of the push-bar conveyor.

12 Claims, 3 Drawing Sheets

APPARATUS FOR THE CONTROLLED FEED OF PRODUCTS IN SHEET FORM IN A COLLATING OR PACKAGING MACHINE

The present invention relates to an apparatus for the controlled feeding of products in sheet form in a collating or packaging machine.

The collating machines for graphic products for the preparation of magazines, books, catalogues, mailings, or other printed matter, are generally constituted by a channel inside which a longitudinal push-bar conveyor is positioned, and several feeding apparatuses.

Such feeding apparatuses are constituted, e.g., by drawers or magazine portions inside which the product in sheet form is stored, arranged parallel to, or in-line with, the above said conveyor, and drawing/feeding devices, called "sheet feeders". Such devices determine, in combination, the drawing and advancement of individual sheets, or sheet signatures or other products essentially in—either folded or not folded—sheet form, on top of the push-bar feeder, such as to form a predetermined succession of collection of groups of products.

A similar operation of collection or assemblage of more or less different products in sheet form is also carried out on so-said "packaging machines", in which to the base product, e.g., fed by another suitable feeder device purposely provided upstream the machine, one or more insert(s) has (have) to be added, wherein each of said inserts can be constituted by one or more sheet(s), sheet bundle(s), or other similar product(s).

In both cases, the operation of drawing and advancement or launch of the product in sheet form, drawn from the magazine drawers and fed to the main push-bar conveyor, creates problems in that the product in sheet form, which is generally launched, should change its running direction relatively to its drawing direction.

Furthermore, such problems increase with increasing operating speeds, in that between the push-bar conveyor, on which a first product may or may not be already present, and the new product in sheet form which is being fed, an air cushion is generated, which does not allow the product in sheet form to correctly and instantaneously set relatively to the same conveyor. Such a problem exists also when the product in sheet form is fed in line.

Furthermore, such a feeding of the product in sheet form in free-falling mode additonally involves, with varying collating or packaging speeds, the consequent change of mutual timing of the feeder device arranged at 90° to, or in-line with, the push-bar conveyor and the same push-bar conveyor. This need arises in that the correct equilibrium has to be established each time, between the processing speed and the speed of feeding of the products in sheet form.

The purpose of the instant invention is of getting rid of such problems relevant to the need of timing setting when the processing speed varies, and deriving from the presence of collating or packaging feeding stations in succession after each other, in which the individual products in sheet form are fed under free-falling conditions between the feeder device and the push-bar conveyor.

This purpose according to the present invention is achieved by providing an apparatus for the controlled feeding of products in sheet form in a collating or packaging machine comprising a framework on which there are installed a magazine portion containing the products in sheet form to be fed, a drawing/advancement unit for drawing one of said products in sheet form from said magazine portion and for advancing it towards a push-bar conveyor on top of which said at least one of said products in sheet form, drawn in that way, has to be placed, which apparatus is characterized in that it comprises at least one accompanying element which performs the task of accompanying said so-drawn product in sheet form to the top of said push-bar conveyor, with said at least one accompanying element being interposed between said drawing/advancement unit and said push-bar conveyor, with actuation means being furthermore provided, which actuator means perform the task of actuating said at least one accompanying element, and intervene whenever said drawn product in sheet form has left said drawing/advancement unit and is placed in the nearby of said push-bar conveyor.

Advantageously, an apparatus provided with a structure according to the present invention by eliminating the air cushion, i.e., the free falling of the product in sheet form, enables said product to be correctly and constantly placed on top of said push-bar conveyor, or in an equivalent way above similar elements in sheet form previously placed above the push-bar conveyor.

The characteristics and advantages of the present invention will be clearer from the disclosure thereof, provided for merely exemplifying, non-limitative purposes, by referring to the hereto attached schematic drawings, in which.

Figure 1:
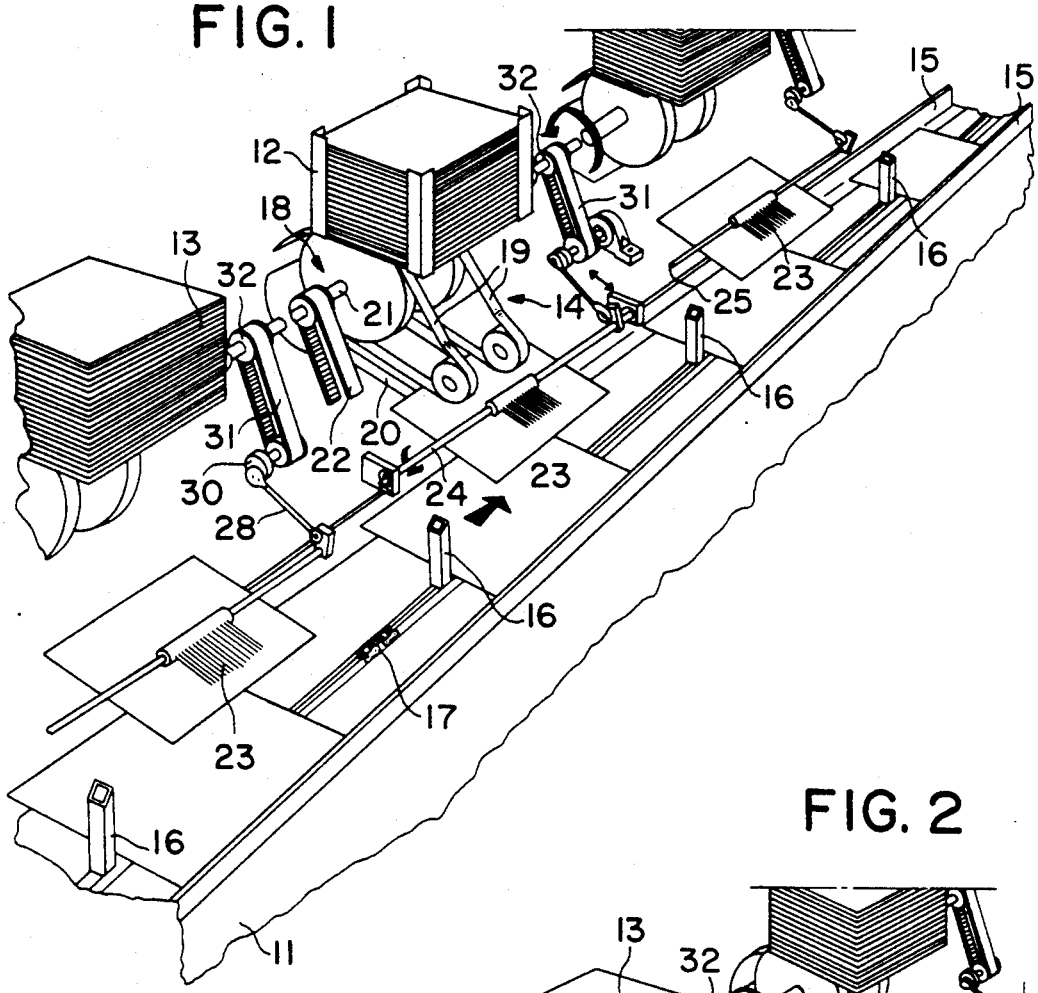
FIG. 1 shows a schematic perspective view of an apparatus according to the present invention, during a first operation step thereof.
Figure 2:
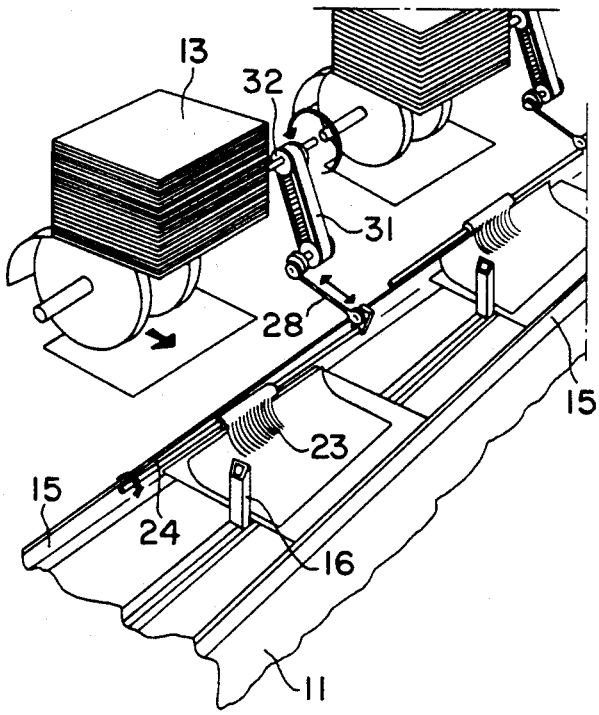
FIG. 2 shows a partial view equivalent to the view of FIG. 1 during a second operating step thereof, and FIGS. from 3 to 8 shows schematic views of different, exemplifying forms of practical embodiments of the apparatus according to the present invention.

Referring to FIGS. 1 and 2, an apparatus for the controlled feeding of products in sheet form is associated with a collating or packaging machine, only partially shown, which comprises a base framework 11 on which there are essentially installed a magazine portion 12 containing the products in sheet form 13 to be fed, a drawing/advancement unit, generally indicated with the reference numeral 14, for drawing one of said products in sheet form 13, and a push-bar conveyor which is arranged between side walls 15, which define a channel. In the herein shown example, said conveyor is only indicated by means of its push-bar elements 16 and the drive chain 17 which drives said push-bar elements.

In the exemplifying form of practical embodiment depicted in FIGS. 1 and 2, a drawing/advancement unit 14 is shown, which is arranged at 90° to the underlying push-bar conveyor; hoiwever, in an at all equivalent way, such an unit could be arranged directly in-line to the channel or push-bar conveyor.

Such a drawing/advancement unit is exemplified by revolving elements 18 with associated belts 19 which draw at least one product in sheet form 13 from the magazine portion 12 and—by cooperating with further associated belts 20—cause said product in sheet form 13 to advance towards the push-bar conveyor. The revolving elements 18 are driven to revolve by a central shaft 21 actuated in its turn by means of a transmission 22, such as, e.g., a cogged belt, which transmits to said central shaft the motion drawn from the motor means (per se known, and not shown herein) which drive the push-bar conveyor. In that way, a mechanical timing between the push-bar conveyor 16, 17 and the drawing-/advancement unit 14 is accomplished.

Between the drawing/advancement unit 14 and the push-bar conveyor 16, 17, an apparatus is installed according to the instant finding, which carries out the controlled feeding of the prodicts in sheet form 13. Such an apparatus essentially comprises at least one accompanying element which accompanies said drawn product in sheet form 13 during its movement.

Such a sheet product accompanying element is, as said, interposed, and is actuated by actuation means which cause it to intervene once that the product in sheet form 13, drawn from the magazine portion 12, has left the drawing/advancement unit 14 and must be placed in the nearby of the push-bar conveyor 16, 17.

Figure 3:
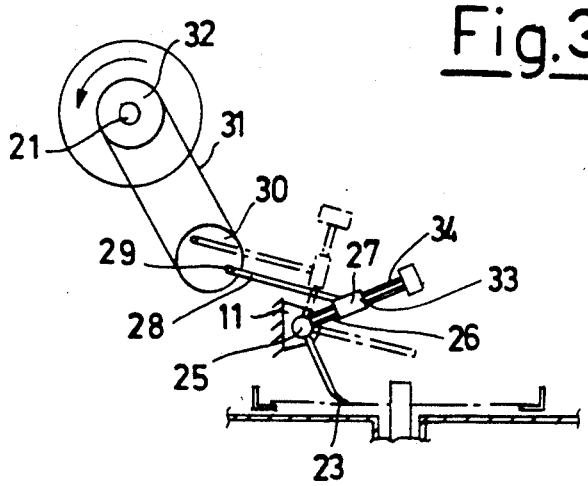

The exemplifying form of practical embodiment shown in FIGS. 1 and 2 exactly corresponds to the scheme shown in FIG. 3 and shows that the accompanying element is constituted by a flexible brush 23 positioned on a spindle 24 which is hinged in 25 relatively to the framework 11 and bears a lever 26 integral with it. In its turn, the lever 26 is hinged in 27 onto a first end of a driven connecting rod 28, whose second end is hinged in 29 to a crank 30, accomplished by means of a first cogged wheel constrained to the framework 11, however free of revolving, by being actuated by a cogged belt 31 inmeshing with a second cogged pulley 32 rigidly keyed on the central shaft 21. In this way, a rigid and synchronous mechanical transmission is created between the motor means which drives the push-bar conveyor, and the motor means which drive the drawing/advancement means and the several accompanying elements.

From FIG. 3, it can be further observed that a means is provided for adjusting the position of the hinge 27 which links the connecting rod 28 and the lever 26. In such exemplifying—however, non-limitative—form of practical embodiment, the adjustment is achieved by means of a sleeve 33 provided with an inner screw-threading and inmeshing, which possibility of position adjustment, on the screw-threaded provided on at least one portion 34 of the lever 26.

Figure 4:
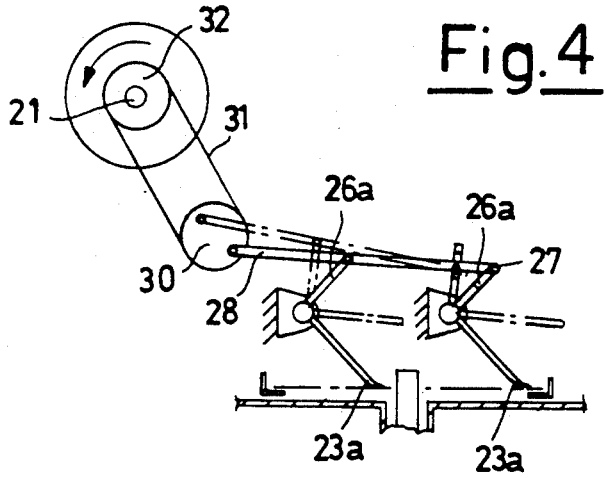

FIG. 4 shows a further exemplifying form of practical embodiment in which the drive connecting rod 28 supplies the movement to a pair of levers 26*a*, to which a pair of flexible brushes 23*a* are constrained. It should be observed how the second hinging pin 274 on the lever 26*a* which is the farther away from the crank 30 is inserted inside a slot provided in the same lever 26*a*. In this way, a better action of accompanying of the product in sheet form to the top of the push-bar conveyor is obtained.

Figure 5:
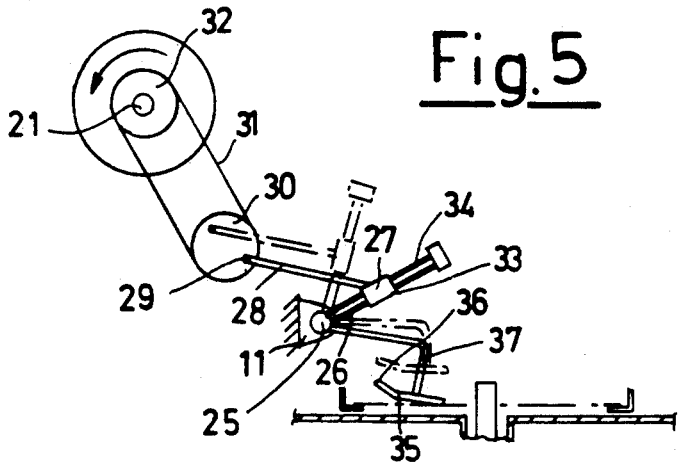

FIG. 5 is essentially equivalent to FIG. 3 and in it same reference numerals are used for equal parts, apart from the fact that the flexible brush 23 is replaced by a rigid brush, which can be variously shaped. In an equivalent way, such a rigid brush can be constituted by a shaped metal plate 35, interacting with the product in sheet form, provided with an invitation edge 36 facing upwards at its end opposite to the drawing/advancement unit 14, and supported on a shaped square lever 37 extending from the hinging pin 25 and rigidly constrained to the lever 26.

Figure 6:
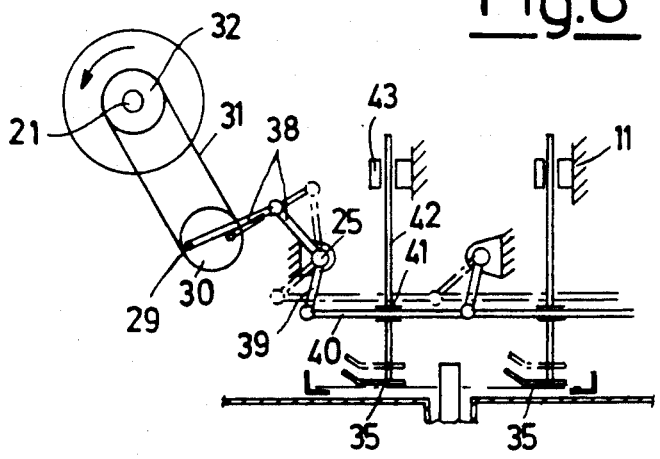

FIG. 6 shows a further exemplifying form of practical embodiment in which onto the crank 30 a drive connecting rod and lever 26 are hinged in 29—which are replaced by two lever portions 38 arranged at a square angle to each other and at their other end are hinged in 25 onto the frame 11. Said two lever portions 38 are rigidly linked, at their other side relatively to the hinge pin 25, with a further first lever portion 39 whose free end is hinged relatively to at least one second lever portion 40.

The second lever portion 40 is slidingly inserted inside a guide element 41 provided in an extension of a rod 42 bearing at its free end the rigid brush, or shaped metal plate 35. Furthermore, another free end of said rod 42 is inserted, with possibility of free translation, inside a second guide element 43 integral with the framework 11 and arranged perpendicular to the first guide element 41. In particular, FIG. 6 shows a pair of accompanying elements and consequently the guide elements and the drive elements are doubled.

Figure 7:
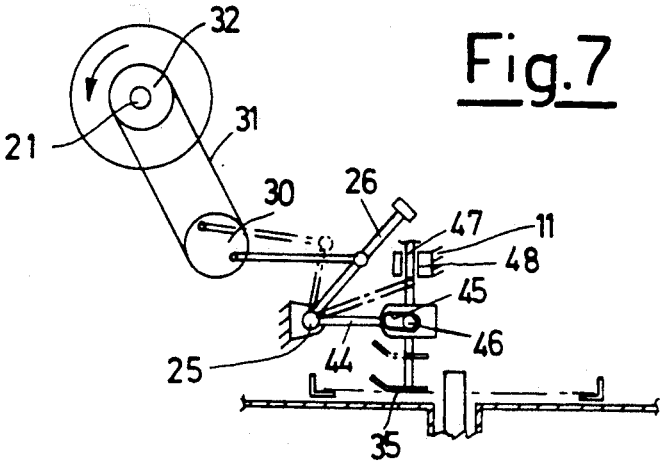

FIG. 7 shows an apparatus according to the present invention, which partially resembles the just disclosed apparatus as regards the accompanying element 35. However, one should observe that the lever 26 extends beyond the hinge pin 25, in a further lever portion 44 bearing at its free end a slot 45 inside which a pin 46 enters with possibility of free sliding. The pin 46 is integral with a rod, or extension 47, which at one of its ends bears, as said, the accompanying element 35 and at its other end is slidingly guided inside a guide element 48 integral with the framework 11. The guide element 48 is arranged substantially vertical to the accompanying element 35 and therefore to the plane of the push-bar conveyor 16, 17. Also in this case, an essentially vertical movement of the accompanying element is achieved.

Figure 8:
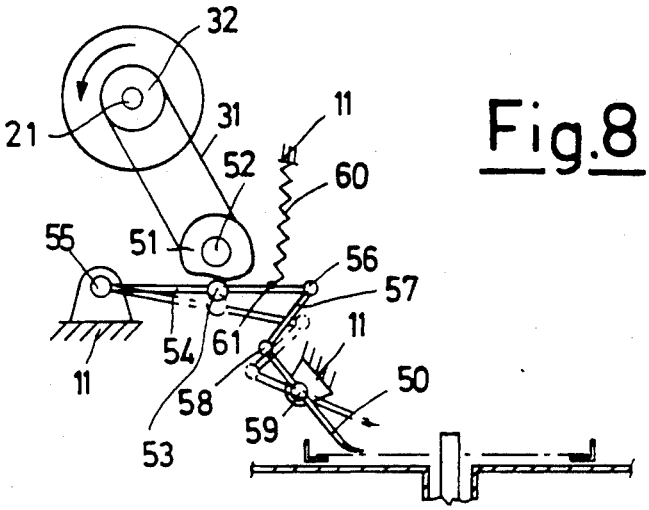

Then, as regards FIG. 8, it should be observed that in it an exemplifying form of practical embodiment is shown, which is slightly different from the other forms of practical embodiment discussed hereinabove, in that as the actuation means, a cam coupling is used in it.

More precisely, the actuation of said at least one accompanying element 50, e.g., of the flexible-brush type, takes place by means of a cam element 51 which is made integral with a pivot 52 driven by the cogged belt 31 which draws its movement from the main shaft 21. With said cam element a revolving pin 53 cooperates, which is positioned on a rocking arm 54 hinged at one of its ends 55 onto said framework 11. At the other end of the rocking arm 54 the first end of a link 57 is linked in 56. At its other end, said link 57 is hinged in 58 onto an end of the accompanying element 50. It should be observed that such an accompanying element is hinged in 59—at its middle region—onto the framework 11. In the herein shown case, in which the cooperation takes place between the revolving pin 53 and the outer surface of the cam element 51, an elastic element 60 has to be provided, which is constrained at one of its ends, in 61, to the rocking arm 54, and at its other end to the framework 11. Of course, providing such an elastic element is not necessary if the revolving pin interacts with a race provided inside the body of the cam element.

An apparatus according to the present invention, independently from its preferred exemplifying form of practical embodiment, determines an oscillatory movement of the accompanying element, which is timed relatively to the advancement of the product in sheet form 13 leaving the drawing/advancement unit 14. In fact, when the product in sheet form first comes to it, the accompanying element is raised, so as to facilitate said product in sheet form to enter the free gap defined between it and the underlying push bar conveyor, thus the arising of any contrast problems being prevented at all.

As soon as the product in sheet form has entered the channel defined by the side walls 15 of the push bar conveyor 16, 17, the accompanying element driven by the relevant actuation means moves downwards or rocks, thus causing the mechanical accompanying to take place of the product in sheet form 13 to the underlying surface which can either be a further, previously fed, element, or just the surface of the push bar conveyor. Thus, the presence of the accompanying element which lowers the product in sheet form does not allow the air cushion experienced in the apparatuses known from the prior art, to be formed.

Such a lowered or rocked position is maintained throughout the step during which the product in sheet form is pushed out from the drawing/advancement unit 14, so as to secure that the product in sheet form will be perfectly deposited on the underlying surface and will take the same speed of advancement as of the push bar conveyor and/or of the possible product previously deposited on the same push bar conveyor.

The presence of adjusting means in the actuation means which drive the accompanying element makes it possible the apparatus according to the present invention to be adapted to the particular needs dictated by the nature of the product in sheet form to be processed.

We claim:

1. Apparatus for the controlled feeding of products in sheet form in a collating or packaging machine comprising a framework on which there are installed a magazine portion containing the products in sheet form to be fed, a drawing/advancement unit for drawing one of said products in sheet form from said magazine portion and for advancing it towards a push-bar conveyor on top of which at least one of said products in sheet form, drawn in that way, has to be placed, said apparatus being characterized in that it comprises at least one accompanying element which performs the task of accompanying said so-drawn product in sheet form to the top of said push-bar conveyor, at least one said accompanying element being interposed between sid drawing-/advancement unit and said push-bar conveyor, with actuator means being provided, said actuator means being adapted to perform the task of actuating said at least one accompanying element, and intervening whenever said drawn product in sheet form has left said drawing/advancement unit and is placed in the vicinity of said push-bar conveyor wherein said actuator means for said at least one accompanying element comprises a lever which at one of its ends is hinged onto said framework and supports said accompanying element, and at its other end is hinged to a drive connecting rod which causes it to oscillate, with said drive connecting rod being furthermore hinged, at its second end, onto a crank which is driven to revolve by motor means associated with said drawing/advancement means.

2. Apparatus according to claim 1, characterized in that on the side at which it is hinged onto said framework, said lever extends in a first lever portion bearing, hinged to its free end, a second lever portion entering a guide element provided in an extension of said at least one accompanying element, with said guide element sliding in its turn inside a second guide element integral with said framework and arranged in a perpendicular position to said guide element for said extension.

3. Apparatus according to claim 1, characterized in that said lever, on its side at which said lever is hinged to said framework, extends in a further lever portion bearing, and having at its other free end, a slot inside of which a pin slides, which pin is integral with an extension of said at least one associated element, with said extension furthermore being engaged inside a freely sliding way which is inside a guide element integral with said framework and essentially vertical to the plane defined by said push-bar conveyor.

4. Apparatus according to claim 1, characterized in that the position of the hinging point of said drive connecting rod on said lever can be adjusted by means of adjusting means associated with said lever.

5. Apparatus according to claim 1, characterized in that said actuator means for said at least one accompanying element comprises a cam element which is driven to rotate by motor means associated with said drawing-/advancement unit, and a revolving pin interacting with said cam element, which is positioned on a rocking arm which at one of its ends is hinged onto said framework, and at its opposite end bears a first end of a link at whose other end a first end of said at least one accompanying element is hinged, with said accompanying element being furthermore hinged at a middle portion thereof, onto said framework.

6. Apparatus according to claim 5, characterized in that said revolving pin of said rocking arm is kept into contact with said cam element by means of elastic elements constrained to said framework.

7. Apparatus according to claim 1, characterized in that said at least one accompanying element is a flexible brush.

8. Apparatus according to claim 1, characterized in that said at least one accompanying element is a rigid brush.

9. Apparatus according to claim 1, characterized in that said at least one accompanying element is a shaped metal plate.

10. Apparatus according to claim 9, characterized in that said shaped metal sheet is arranged essentially parallel to the plane of said push-bar conveyor and has an upwards-facing invitation edge at its end facing said drawing/advancement unit.

11. Apparatus according to claim 1, characterized in that said at least one accompanying element is provided with adjustment means for adjusting the position thereof relative to said actuator means.

12. Apparatus according to claim 11, characterized in that a hinging pin linking said actuator means and said accompanying element is constrained onto a sleeve provided with an inner screw-threading and which can be adjusted in position relative to a partially screw-threaded lever bearing on said at least one accompanying element.

* * * * *